US009845223B2

(12) United States Patent
Krämer et al.

(10) Patent No.: US 9,845,223 B2
(45) Date of Patent: Dec. 19, 2017

(54) CONVEYING APPARATUS

(71) Applicant: ThyssenKrupp Elevator AG, Essen (DE)

(72) Inventors: Reinhardt Krämer, Hamburg (DE); Julius Schlattmann, Hamburg (DE)

(73) Assignee: ThyssenKrupp Elevator AG, Essen (DE)

( * ) Notice: Subject to any disclaimer, the term of this patent is extended or adjusted under 35 U.S.C. 154(b) by 0 days.

(21) Appl. No.: 15/107,134

(22) PCT Filed: Dec. 18, 2014

(86) PCT No.: PCT/EP2014/003426
§ 371 (c)(1),
(2) Date: Jun. 22, 2016

(87) PCT Pub. No.: WO2015/096895
PCT Pub. Date: Jul. 2, 2015

(65) Prior Publication Data

US 2017/0001836 A1 Jan. 5, 2017

(30) Foreign Application Priority Data

Dec. 23, 2013 (DE) ..... 10 2013 227 130

(51) Int. Cl.

| | |
|---|---|
| ***H04R 25/00*** | (2006.01) |
| ***B66B 7/00*** | (2006.01) |
| ***B66B 23/24*** | (2006.01) |
| ***B66B 29/08*** | (2006.01) |
| ***B66B 31/02*** | (2006.01) |
| ***E01D 19/10*** | (2006.01) |
| ***H04R 1/02*** | (2006.01) |

(52) U.S. Cl.
CPC ..... *B66B 7/00* (2013.01); *B66B 23/24* (2013.01); *B66B 29/08* (2013.01); *B66B 31/02* (2013.01); *E01D 19/103* (2013.01); *H04R 1/028* (2013.01)

(58) Field of Classification Search
CPC ..... B66B 7/00; B66B 23/24; B66B 31/02; E01D 19/103; H04R 1/028
USPC ..... 381/151
See application file for complete search history.

(56) References Cited

U.S. PATENT DOCUMENTS

| | | | | |
|---|---|---|---|---|
| 2,804,191 | A | 8/1957 | King | |
| 3,685,635 | A | 8/1972 | Johnson | |
| 4,139,742 | A | 2/1979 | Walker | |
| 5,178,254 | A | 1/1993 | Saito et al. | |
| 7,020,288 | B1 * | 3/2006 | Ohashi | G10K 11/178 381/71.4 |

FOREIGN PATENT DOCUMENTS

| | | | |
|---|---|---|---|
| CN | 2572704 | Y | 9/2003 |
| CN | 1791444 | A | 6/2006 |

(Continued)

*Primary Examiner* — Sean H Nguyen
(74) *Attorney, Agent, or Firm* — The Webb Law Firm

(57) ABSTRACT

The invention relates to a transporting apparatus for transporting people, characterized by at least one structure-borne-sound-transmission region, which is acted on directly or indirectly by a structure-borne-sound transducer which is intended to generate vibrations which, when the structure-borne-sound-transmission region is touched by a person, are transmitted as structure-borne sound via the person's body and are audible to the person.

10 Claims, 1 Drawing Sheet

(56) References Cited

FOREIGN PATENT DOCUMENTS

| | | | | |
|---|---|---|---|---|
| CN | 1810062 | A | | 7/2006 |
| DE | 2905276 | A1 | | 8/1980 |
| DE | 212009000242 | U1 | | 10/2012 |
| DE | 102011086231 | A1 | | 5/2013 |
| EP | 2659344 | | | 11/2013 |
| JP | 200627828 | A | | 2/2006 |
| JP | 2008265993 | A | * | 11/2008 |

* cited by examiner

CONVEYING APPARATUS

CROSS-REFERENCE TO RELATED APPLICATIONS

This application is the United States national phase of International Application No. PCT/EP2014/003426 filed Dec. 18, 2014, and claims priority to German Patent Application No. 10 2013 227 130.1 filed Dec. 23, 2013, the disclosures of which are hereby incorporated in their entirety by reference.

BACKGROUND OF THE INVENTION

Field of the Invention

The present invention relates to a transporting apparatus for transporting people.

Description of Related Art

The prior art discloses a wide variety of embodiments of transporting apparatus for transporting people, for example escalators, walkways and elevator systems.

The known transporting apparatuses have the disadvantage that it is difficult to supply information to a person being transported, and the time spent by the person in or on a transporting means often cannot be utilized by that person for anything else.

For example, it has been found to be particularly awkward to supply visual information to an escalator user during travel since, in this case, for example the optical media (screens) used are usually static and a person being transported is therefore moving relative thereto. It can also be difficult to provide acoustic information by means of announcements, or also to play background music in such transporting apparatuses, since the user here may be exposed to an irrelevant or annoying stream of information.

It is therefore desirable to provide transporting apparatuses in which it is possible for a person who is being transported to be provided with information, or entertainment, on a selective basis.

SUMMARY OF THE INVENTION

The solution according to the invention of designing a transporting apparatus with a structure-borne-sound-transmission region makes it straightforwardly possible for users of a transporting apparatus to be provided with information on a selective basis. Using structure-borne sound according to the invention makes it possible for a person being transported to decide for himself whether he would like to call up, for example, a certain piece of information or not. Overall, it is thus possible to minimize the extent to which people being transported are exposed to sound information which concerns just one person, or certain people, but can be perceived by all the people being transported in a transporting apparatus or even by people in the vicinity of the transporting apparatus.

For a user, this may also constitute an incentive to use a transporting apparatus according to the invention.

Transporting apparatus within the context of the present invention is understood to be a means of transporting people, in particular over short distances of up to approximately 1000 m. In particular it is possible for a transporting apparatus to be designed in the form of an escalator, walkway or elevator system. The aforementioned term, however, should also cover boarding bridges, e.g. jet bridges, that is to say mechanisms which link a terminal building of an airport and at least one cabin door of a parked passenger aircraft. Such boarding bridges may be designed, in particular, also with an escalator or a walkway. The term boarding bridges, however, should also cover for example bridges for access to ships, e.g. cruise ships. Not covered by the term transporting apparatus are explicitly means of transport intended for longer distances, such as automobiles or trains.

The transporting apparatus according to the invention has structure-borne-sound-transmission regions, which are suitable for providing vibrations which, when the apparatus is touched by a person being transported, can be perceived in the form of sound. So-called structure-borne-sound transducers are used in order to generate the vibrations. The structure-borne-sound-transmission regions may be designed to be stationary or movable, for example along with a moving handrail. The structure-borne-sound-transmission regions may be designed to be stationary or movable, for example along with a moving handrail.

These vibrations here are transmitted for example from the user's hand, which is resting on the structure-borne-sound-transmission region, to his inner ear via his skeleton. Such sound transmission is also referred to as structure-borne-sound transmission.

In the inner ear, the vibrations of the auditory ossicles are processed and passed on, in the form of electric signals, to the auditory centers of the brain, where they are perceived in the form of sound or tone. This sound cannot be perceived by other passengers.

The configuration of the invention in the form of an escalator or of a moving walkway is particularly advantageous since, in this case, the means for transmitting information, that is to say structure-borne-sound transducers and structure-borne-sound-transmission regions, can readily move along with a person who is being transported.

The at least one structure-borne-sound-transmission region is expediently formed in or on a hand-hold device of the transporting apparatus. A hand-hold device may be a moving handrail, for example in the case of an escalator or of a moving walkway, or a handrail, in the case of an elevator system.

It is expedient here for certain regions of the hand-hold device to be designed in the form of structure-borne-sound-transmission regions and for other regions of the hand-hold device not to be designed as such. It is recommended here to mark the structure-borne-sound-transmission regions, for example using color or haptic means. Such a marking makes it possible for a person being transported to decide for himself whether he would like to touch a structure-borne-sound-transmission region or not.

It is particularly preferred here for the structure-borne-sound-transmission regions to be formed in or on a moving handrail of an escalator or of a moving walkway. For example it is possible for structure-borne-sound transducers to be fastened on the moving handrail, in or beneath the same, so that they can move therewith.

In a preferred configuration, it is possible to provide an intermediate element between the structure-borne-sound transducer and the moving handrail, the structure-borne-sound transducer transmitting vibrations to the moving handrail via said intermediate element. Such intermediate elements, which may be produced for example on appropriately formed metal plates, can be fixed particularly straightforwardly on a moving handrail. It is also a straightforward task to fit structure-borne-sound transducers on such intermediate elements.

A further configuration is the stimulation of a handrail guide, on which the handrail or the moving handrail slides. A structure-borne-sound transducer may be fastened in a stationary manner on the handrail guide. The advantage with this configuration is that the structure-borne-sound transducer need not be transported along. Transmission of the vibration to the upper side of the handrail can take place, once again, by way of above-mentioned intermediate elements, which have been introduced into the handrail.

It is also possible, for example in the case of an elevator car, for the at least one structure-borne-sound-transmission region to be formed in a wall of the elevator car. For example, it is conceivable for one or more walls of an elevator car to be designed with panels, behind each of which structure-borne-sound transducers are formed. In the case of such a configuration, these panels therefore constitute structure-borne-sound-transmission regions. It is possible, in the case of this configuration, for the panels to be fitted at head height, and therefore the vibrations can be transmitted to the auditory ossicles directly via the cranial bones.

Further advantages and configurations of the invention can be gathered from the description and the accompanying drawing.

Of course, the features which have been mentioned above and those which are yet to be explained hereinbelow can be used not just in the combination indicated in each case, but also in different combinations, or even on their own, without creating a departure from the framework of the present invention.

The invention is illustrated schematically by exemplary embodiments in the drawing and will be described in detail hereinbelow with reference to the drawings.

BRIEF DESCRIPTION OF THE DRAWINGS

In FIGS. 1 and 2, like, or similar, elements are provided with like reference signs.

DESCRIPTION OF THE INVENTION

Figure 1:
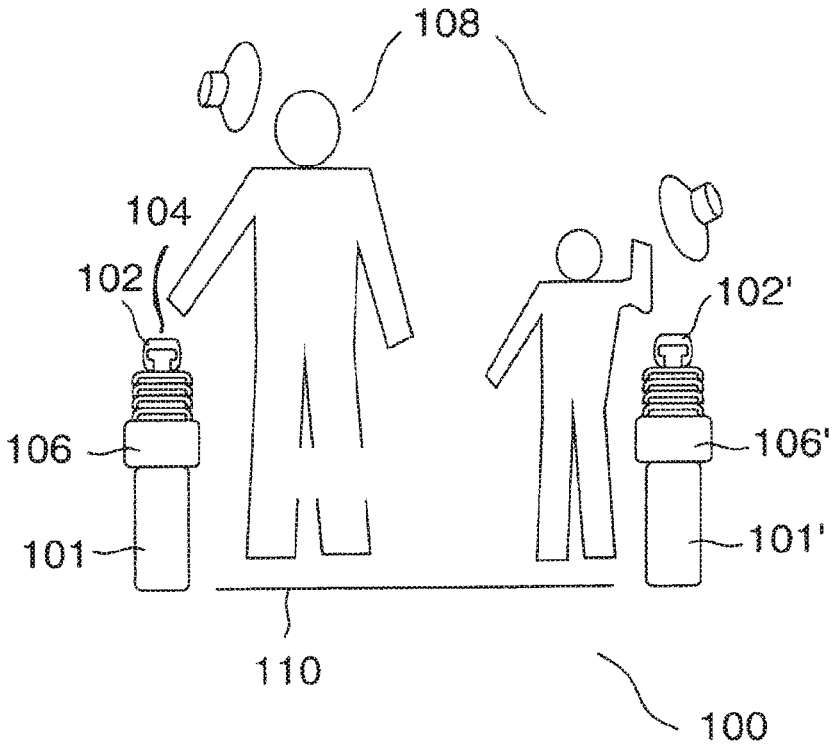
FIG. 1 shows a schematic, partly sectional plan view of a preferred embodiment of a transporting apparatus according to the invention.

A particularly preferred embodiment of a transporting apparatus according to the invention is illustrated schematically in FIG. 1. The transporting apparatus is designed here in the form of a moving walkway and is designated as a whole by 100. The moving walkway has a belt conveyor 110, on which people 108 who are being transported stand, and two side walls or balustrades 101, 101', on each of which a moving handrail 102, 102' is formed.

The speed of the moving handrails 102, 102' is coordinated during normal operation, that is to say when people are being transported, with the speed of the belt conveyor 110.

Structure-borne-sound transducers 106 are formed at regular intervals on the underside of the respective moving handrails 102, 102' and move along with the moving handrails 102, 102'. From a perspective of FIG. 1, just one structure-borne-sound transducer can be illustrated for each moving handrail. It is, for example, possible for the respective structure-borne-sound transducers to be provided at intervals of, for example, 50 cm or 100 cm or 200 cm in relation to one another in or on the moving handrails 102, 102'.

The structure-borne-sound transducers 106 generate vibrations at frequencies which can be transmitted in the form of structure-borne sound through the respective moving handrail 102, 102' to a transporting-apparatus user 108, who is touching the moving handrail 102, 102' with a hand or some other suitable part of his body. The regions of the moving handrails 102, 102' in which structure-borne-sound transducers are formed therefore constitute structure-borne-sound-transmission regions 104. These vibrations are depicted in FIG. 1 symbolically in the form of curves between the structure-borne-sound transducers 106 and the moving handrails 102, 102'.

A person 108 being transported uses for example his hand or elbow to touch a structure-borne-sound-transmission region 104 of the moving handrail 102. This contact can give rise to vibrations generated by a structure-borne-sound transducer 106 being transmitted in the form of structure-borne sound via the person's body, in particular via his bones or skeleton, to the ear (inner ear), where the structure-borne sound is perceived in the form of sound or tone.

The respective structure-borne-sound-transmission regions of a moving handrail 102, 102' are expediently marked as such and are therefore evident to a person who is using the transporting apparatus. It is, for example, possible for the structure-borne-sound-transmission regions to be identified using color or haptic means, for example by the moving handrail being ribbed. Between the respective structure-borne-sound-transmission regions, it is thus also possible to provide regions which are not assigned any structure-borne-sound transducers, and in which it is not therefore possible for any structure-borne-sound transmission to take place. A person who is using the transporting apparatus can therefore choose whether he would like to use a structure-borne-sound-transmission function or not.

Figure 2:
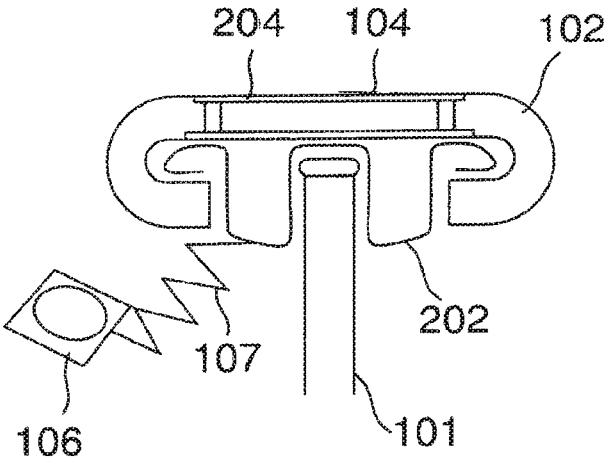
FIG. 2 shows a schematic sectional view of a further preferred embodiment of a moving handrail which can be used according to the invention.

FIG. 2 shows a detailed sectional view of part of a moving walkway according to a second embodiment. The moving handrail 102 and the side wall 101 are evident. In this exemplary embodiment, rather than being connected to the moving handrail 102 directly, the structure-borne-sound transducer 106 is connected thereto with the interposition of a handrail guide 202 and of an intermediate element 204. The structure-borne-sound transducer or transducers and the handrail guide 202 are of static design here, that is to say they do not move with the moving handrail 102. The handrail guide 202 is formed with a W-shaped profile, via which the intermediate element 204 slides. The intermediate element 204 here moves with the moving handrail 102. The vibrations of the stationary structure-borne-sound transducer 106 are transmitted to the upper side of the moving handrail 102 here from the handrail guide 202 and the intermediate element 204. The structure-borne-sound transducer 106 can be fitted directly on the handrail guide 202, for example at a suitable location of the W-shaped profile, and can cause the same to vibrate. The connection 107, as contained in FIG. 2, serves merely to illustrate the structure-borne-sound transducer 106 to better effect. The handrail guide and intermediate element are produced preferably from a material which has good structure-borne-sound-conducting properties, e.g. a suitable metallic material.

In a further configuration, it is also possible, by means of such an intermediate element, to transmit vibrations from a structure-borne-sound transducer 106 to a larger region of the moving handrail 102 than would be possible if the structure-borne-sound transducer 106 were fitted directly on the moving handrail 102. It is possible, by means of the intermediate elements 202, for the structure-borne-sound-transmission regions to be formed and/or dimensioned in a desired manner.

It should be ensured that the intermediate element is flexible to the extent where it can be adapted, at the ends or curved sections of the moving walkway, to the moving-handrail curvature which is present there. This can be ensured, for example, by the metallic material (e.g. metal plate) from which the intermediate element is formed being appropriately thin and/or narrow.

This preferred embodiment allows straightforward retrofitting of structure-borne-sound transducers in existing transporting apparatuses, and also cost-effective and flexible integration options, since for example the structure-borne-sound transducer 106 need not be coordinated with the dimensions of the moving handrail 102.

It is possible for the structure-borne-sound-transmission regions to be designed with microstructured or nanostructured surfaces, this making it possible to provide for self-cleaning effects. This measure makes it possible to ensure that the structure-borne-sound-transmission regions can always be kept clean, so that a person who is using the transporting apparatus is motivated to touch the structure-borne-sound-transmission regions.

LIST OF REFERENCE SIGNS

100 Moving walkway according to the invention
101 Side wall, left-hand
101' Side wall, right-hand
102 Moving handrail
102' Moving handrail
106 Structure-borne-sound transducer, left-hand
106' Structure-borne-sound transducer, right-hand
107 Connection
108 People being transported
110 Belt conveyor
202 Handrail guide
204 Intermediate element

The invention claimed is:

1. A transporting apparatus for transporting people, comprising one structure-borne-sound-transmission region on the transporting apparatus, which is acted on directly or indirectly by a structure-borne-sound transducer which is adapted to generate vibrations which, when the structure-borne-sound-transmission region is touched by a person, are transmitted as structure-borne sound via the person's body and are audible to the person, and wherein the transporting apparatus is in the form of an escalator, moving walkway, elevator system, or boarding bridge.

2. The transporting apparatus as claimed in claim 1, wherein the at least one structure-borne-sound-transmission region is formed in or on a hand-hold device of the transporting apparatus.

3. The transporting apparatus as claimed in claim 2, wherein the at least one structure-borne-sound transducer is fitted in a stationary manner on a handrail guide.

4. The transporting apparatus as claimed in claim 3, wherein the at least one structure-borne-sound transducer is integrated in a moving handrail of the escalator or in the moving walkway.

5. The transporting apparatus as claimed in claim 3, wherein an intermediate element is formed between the moving handrail and the structure-borne-sound transducer.

6. The transporting apparatus as claimed in claim 1, wherein the at least one structure-borne-sound-transmission region is formed in or on a moving handrail of the escalator or in the moving walkway.

7. The transporting apparatus as claimed in claim 1, wherein the transporting apparatus has structure-borne-sound-transmission regions and regions which do not transmit structure-borne-sound, said regions being distinguishable from one another by appropriate markings.

8. The transporting apparatus as claimed in claim 1, wherein the boarding bridge comprises one of a jet bridge and a cruise ship bridge.

9. A transporting apparatus for transporting people, comprising one structure-borne-sound-transmission region, which is acted on directly or indirectly by a structure-borne-sound transducer which is adapted to generate vibrations which, when the structure-borne-sound-transmission region is touched by a person, are transmitted as structure-borne sound via the person's body and are audible to the person, wherein the transporting apparatus is in the form of an elevator system, and the at least one structure-borne-sound-transmission region is formed in a handrail in an elevator car of the elevator system.

10. A transporting apparatus for transporting people, comprising one structure-borne-sound-transmission region on the transporting apparatus, which is acted on directly or indirectly by a structure-borne-sound transducer which is adapted to generate vibrations which, when the structure-borne-sound-transmission region is touched by a person, are transmitted as structure-borne sound via the person's body and are audible to the person, wherein the transporting apparatus is in the form of an elevator system, and the at least one structure-borne-sound-transmission region is formed in a wall of an elevator car of the elevator system.

* * * * *